US010584871B2

(12) United States Patent
Biagioli et al.

(10) Patent No.: US 10,584,871 B2
(45) Date of Patent: Mar. 10, 2020

(54) GAS BURNER WITH MULTIPLE RINGS OF FLAMES FOR COOKING HOBS

(71) Applicant: Defendi Italy S.r.l., Camerano (IT)

(72) Inventors: Cristian Biagioli, Camerano (IT); Luca Breccia, Camerano (IT); Marco Sbaffi, Camerano (IT); Werner Noeth, Camerano (IT)

( * ) Notice: Subject to any disclaimer, the term of this patent is extended or adjusted under 35 U.S.C. 154(b) by 88 days.

(21) Appl. No.: 15/757,974

(22) PCT Filed: Sep. 23, 2016

(86) PCT No.: PCT/IB2016/055694
§ 371 (c)(1),
(2) Date: Mar. 7, 2018

(87) PCT Pub. No.: WO2017/051364
PCT Pub. Date: Mar. 30, 2017

(65) Prior Publication Data

US 2018/0259180 A1 Sep. 13, 2018

(30) Foreign Application Priority Data

Sep. 24, 2015 (IT) ..... UB2015A3850

(51) Int. Cl.
*F23D 14/06* (2006.01)
*F23D 14/58* (2006.01)

(52) U.S. Cl.
CPC ..... *F23D 14/065* (2013.01); *F23D 14/58* (2013.01); *F23D 2900/14062* (2013.01)

(58) Field of Classification Search
CPC ..... F23D 14/04; F23D 14/06; F23D 14/58; F23D 2900/14063; F23D 14/065; F23D 2900/14062
(Continued)

(56) References Cited

U.S. PATENT DOCUMENTS 5,464,345 A * 11/1995 Kwiatek ..... F23D 14/06 126/39 E
8,517,718 B2 * 8/2013 Deng ..... F16K 11/0836 431/12
(Continued)

FOREIGN PATENT DOCUMENTS

| | | |
|---|---|---|
| EP | 2835581 | 2/2015 |
| WO | 2006005428 | 1/2006 |
| WO | 20120001714 | 1/2012 |

*Primary Examiner* — Grant Moubry
*Assistant Examiner* — Rabeeul I Zuberi
(74) *Attorney, Agent, or Firm* — Themis Law

(57) ABSTRACT

A multi flame-ring gas burner for cooktops includes a lower burner body configured to receive at least two injectors facing Venturi ducts; a first burner base with a first cap and with openings for a central flame ring; and a second burner base with a second annular cap and openings for an outer annular flame ring. The lower burner body has a seat for a spark plug interacting with the first burner base; two cylindrical seats having substantially horizontal and parallel axes accommodating two tubular elements internally shaped like linear Venturi ducts; and a substantially tubular portion projecting upward, the first burner base being integral with the projecting tubular portion. An injector-holder unit is applicable to the lower burner body and has two portions that are removably insertable into corresponding through holes in the lower burner body and facing the tubular elements internally shaped like linear Venturi ducts.

18 Claims, 5 Drawing Sheets

Figure 1:
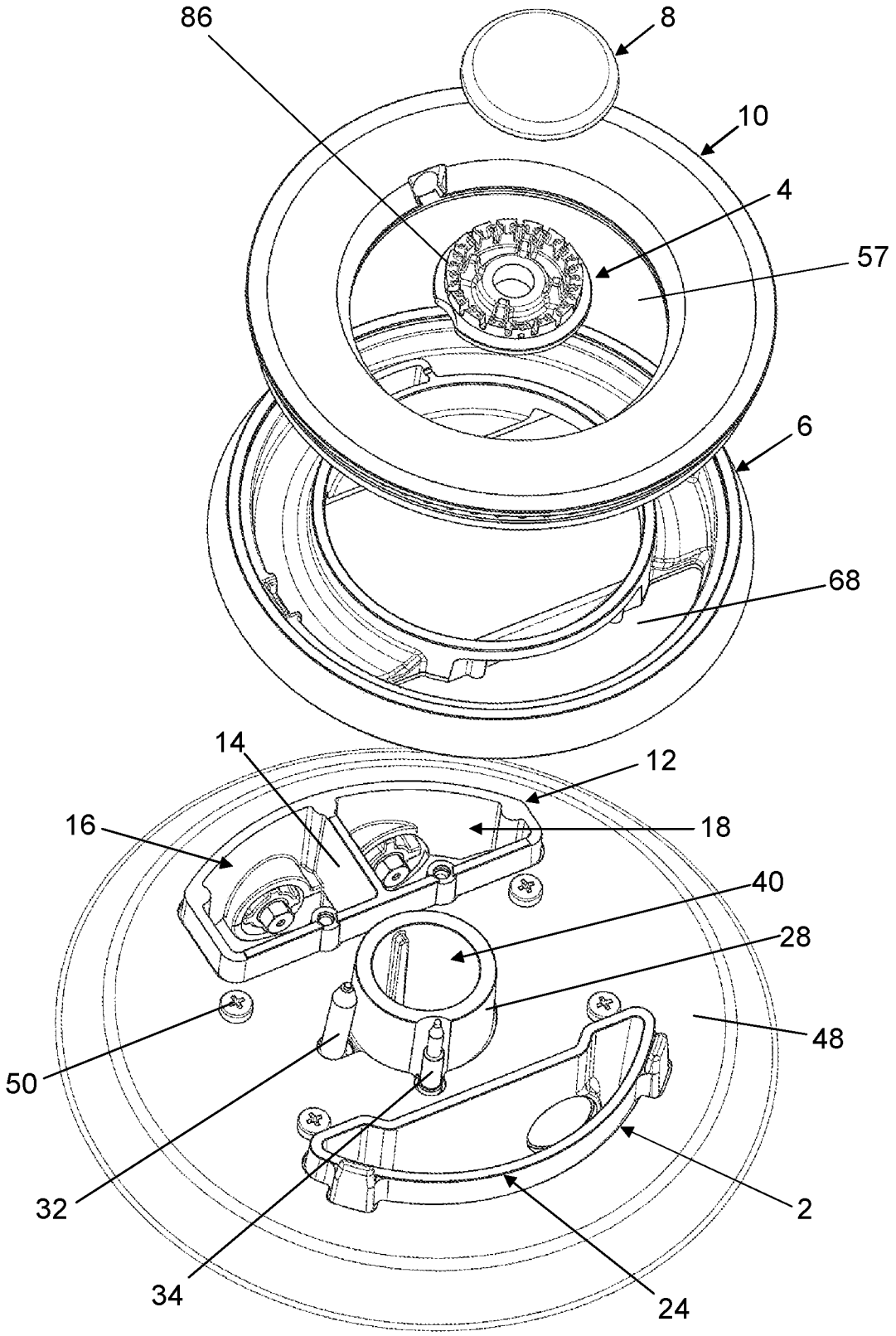

(58) Field of Classification Search
USPC ..... 431/278, 284
See application file for complete search history.

(56) References Cited

U.S. PATENT DOCUMENTS

| | | | | |
|---|---|---|---|---|
| 2007/0026355 | A1* | 2/2007 | Cummings | F23D 14/06 431/354 |
| 2007/0154858 | A1* | 7/2007 | Cadima | F23D 14/06 431/354 |
| 2008/0210216 | A1* | 9/2008 | Rossi | F23D 14/065 126/39 E |
| 2010/0010897 | A1* | 1/2010 | Tyler | G06Q 10/10 705/14.58 |
| 2013/0288186 | A1* | 10/2013 | White | F23D 3/26 431/2 |
| 2013/0306056 | A1 | 11/2013 | Dora | |

* cited by examiner

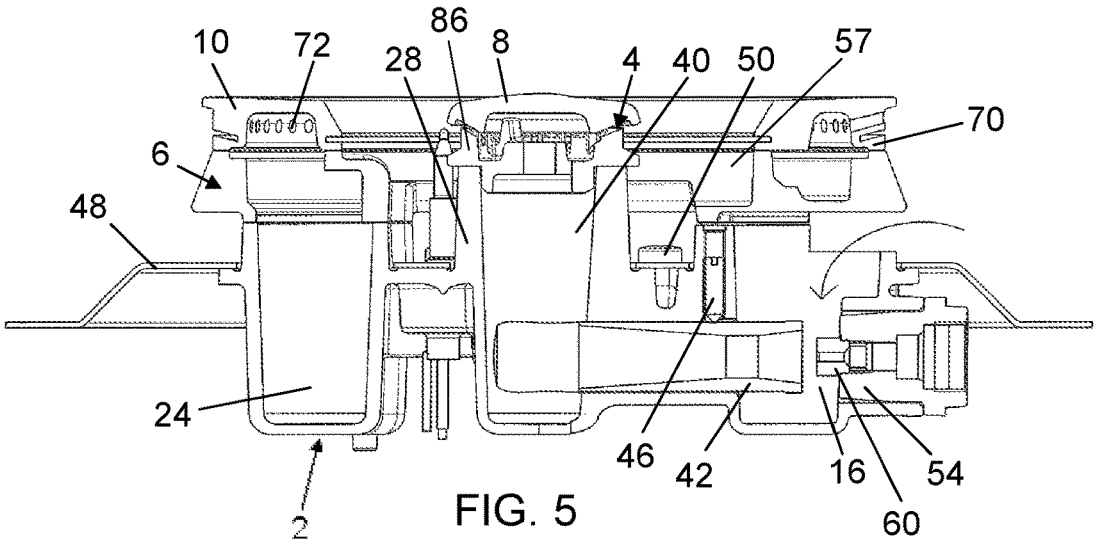
FIG. 5
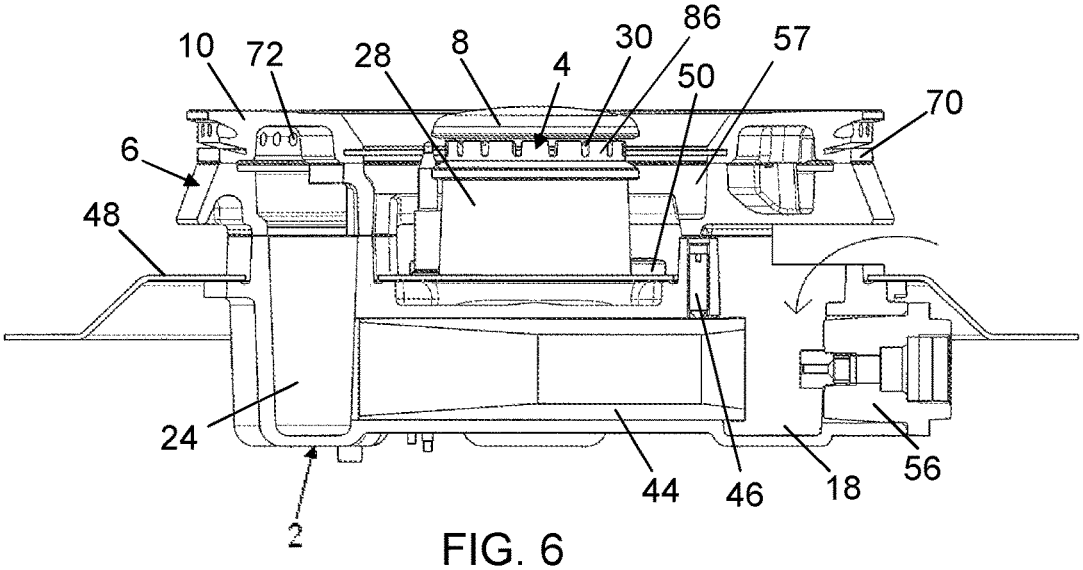
FIG. 6
FIG. 7
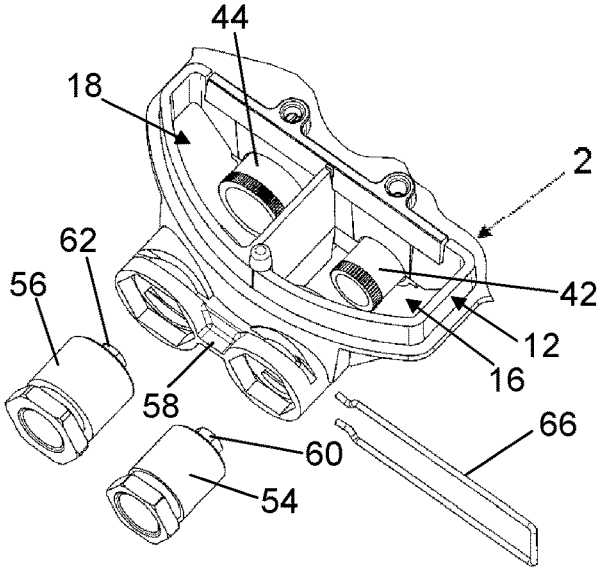

GAS BURNER WITH MULTIPLE RINGS OF FLAMES FOR COOKING HOBS

The present invention relates to a multi flame-ring gas burner for cooktops.

Gas burners with two or more main flame rings for cooktops are known; these burners have an inner circular portion, which generates an inner flame ring, and an outer annular portion, which generates one or two flame rings which are concentric with the flame ring generated by the inner circular portion.

Generally, a burner of this type may have one or more injectors from which a gas flow is released, the flow rate of which is controlled by a valve which can be actuated by the user by means of a knob.

In the case of a single injector or of several injectors connected to a single outlet of the valve, all the flame rings are simultaneously adjusted through that valve, and the burner is commonly referred to as a "multi-ring" burner.

On the other hand, in the case of several injectors connected to two different outlets of the valve, the burner rings may be adjusted with a certain independence, so long as a two-way valve is used; the burner here may be continuously adjusted from a condition of minimum output power, in which the inner ring is fed at the minimum and the outer ring or rings are not fed, to a condition of maximum output power in which all rings are fed at the maximum. This type of burner is commonly referred to as a "dual" burner.

From a constructional point of view, known burners having several flame rings, both multi- and dual-ring, comprise an injector holder, a burner body arranged on the injector holder, a burner base placed on the burner body, and one or two caps placed on the burner base.

The injector holder of traditional burners with several flame rings is generally cup-shaped and is provided with a circumferential flange at which the burner can be constrained to the metal sheet of a cooktop. Moreover, one or more connections for the gas feed ducts and one or more threaded seats for the application of the injectors are provided in the injector holder, which obviously are to be interchangeable according to the type of gas feeding the burner.

The burner body, which in certain cases is made in a single piece with the injector holder, comprises one or more Venturi ducts, in which the gas is mixed with primary air dragged by the gas itself, which mixture is released from the injectors.

The burner base generally consists of a hollow body, which rests on the burner body and has one or more chambers for distributing the mixture over one or more series of openings or outlet ports, through which it may be released to form the flame ring or rings.

The distribution chamber may also carry out a complete mixing, if it was not completed in the Venturi ducts of the burner body.

The cap generally comprises a disc-like portion, which delimits the inner circular distribution chamber of the burner base at the top, and an annular portion, which delimits the outer annular distribution chamber of the burner base at the top.

According to the type of burner, the two cap portions may be distinct or may also be joined to each other by radial connecting segments.

The market offers a wide range of burners of both types and each user makes a selection according to his/her needs, thus preferring certain aspects of the burner and renouncing others.

Moreover, regardless of the features of the different types of known burners with several flame rings, all these have certain drawbacks, which the present invention aims at eliminating.

One of these drawbacks consists in that the burner body is generally made in two parts, which are to be coupled together to form the Venturi duct or the Venturi ducts. As a result, the burner is made of many parts with obvious production and assembly costs and with the risk that coupling them entails problems of unsatisfactory sealing properties and limited safety.

Another drawback consists in the laborious operations for counterboring the surfaces of the different burner components, which are to be coupled to one another to ensure a significant sealing of the couplings. In particular, these counterboring operations are even more complex if there are several separate counterbored surfaces in each burner component, because in this case in addition to the laboriousness of the counterboring operations is the laboriousness associated with the need to ensure the perfect coplanarity between these surfaces.

Another drawback is the inevitable inaccuracy in achieving the so-called spark-gap, i.e. the distance between the electrode of the spark plug, which is generally applied to the injector holder, and the part of the burner which interacts with the spark plug itself to ignite the spark and which generally belongs to the burner base or cap. Indeed, on the one hand, a correct ignition requires an accurate distance between the two, and therefore a minimum tolerance of the spark-gap, and on the other hand this tolerance is the sum of many tolerances, such as the tolerance on the seat of the spark plug, the tolerance on the functional height of the injector-holder cup, the tolerance on the functional height of the burner base, the tolerance on the center distance of the spark plug, the coupling clearances between injector-holder cup and burner base, etc.

Another drawback is the poor flexibility of the burner to adapt it to the existing appearance and functional needs in the various countries, which obligate burner manufacturers to provide a wide range of products for covering the most varied market requests.

WO2012/001714 describes a gas burner for cooktops, where the inner circular burner base element, which generates the central flame ring, and the outer annular burner base element, which generates the two outer annular rings, rest on the same intermediate support body, which in turn rests on a separate lower body of the injector holder made in two distinct pieces. The high number of components of this burner does not ensure a rigorously correct and accurate positioning of spark plug and thermocouple with respect to the inner circular burner base, which is made as a separate element from the lower body of the injector holder and rests on an intermediate support body, with inevitable reciprocal position inaccuracies.

Moreover, the need to create a satisfactory sealing in the couplings between the various components, and in particular in the passages for the fuel mixture, which is formed in the Venturi ducts obtained in the lower body of the injector holder and which should reach the distribution chambers obtained in the burner base, requires an important extension of counterbored surfaces, which is laborious and costly to be achieved.

EP 2503237 describes a gas burner with a circular body, in which an inner circular distribution chamber for generating an inner flame ring and an outer annular distribution chamber for generating an outer flame ring are obtained. A distinct diametral support is placed between the two distribution chambers for a spark plug and a thermocouple, which thus do not have a rigorously accurate position with respect to the inner distribution chamber with which they must interact. Moreover, the two Venturi ducts extend outwards with respect to the volume delimited by the outer annular burner base and this imposes a series of restraints on the methods of installing the burner on the cooktop, and in any case results in a significant overall size of the burner.

It is the object of the present invention to eliminate or at least reduce these drawbacks by means of a multi flame-ring gas burner for cooktops, which can be used both as a multi- and a dual-ring gas burner.

In particular, it is the object of the invention to provide a burner with a limited number of parts and therefore with limited production and assembly costs; more specifically, it is the object of the invention to provide a burner with a body in a single piece, which provides increased sealing guarantees and accordingly safety guarantees.

It is another object of the invention to provide a multi flame-ring burner which may take the primary air to form the fuel mixture intended to feed both the central flame ring and the outer flame ring(s), from above or from below the cooktop.

It is another object of the invention to provide a multi flame-ring burner in which a minimum tolerance of the spark-gap can be achieved without using a very high processing accuracy.

It is another object of the invention to provide a multi flame-ring burner having increased flexibility features both in terms of appearance and in functional terms, and which thus is capable of meeting a high number of different market requests.

It is another object of the invention to provide a multi flame-ring burner in which the injectors can be simply, quickly and conveniently replaced to adapt the burner to different gases, without needing to disassemble the burner itself or without needing to remove it from the cooktop.

It is another object of the invention to provide a multi flame-ring burner in which the distance between the injector or injectors and the Venturi duct or Venturi ducts can be conveniently and efficiently adjusted according to the features of the gas fed, without needing to disassemble the burner from the cooktop.

It is another object of the invention to provide a burner in which there are few, slightly extended surfaces to be counterbored.

It is another object of the invention to provide a multi flame-ring burner with reduced dimensions in plan.

It is another object of the invention to provide a multi flame-ring burner which has an alternative characterization with respect to traditional ones, both in terms of construction and performance.

It is another object of the invention to provide a multi flame-ring burner which can be obtained in a simple, quick manner and with low costs.

All these objects, both individually and in any combination thereof, and others which will become apparent from the description below are achieved according to the invention by an improved multi flame-ring gas burner as defined in claims 1 and 3.

Figure 2:
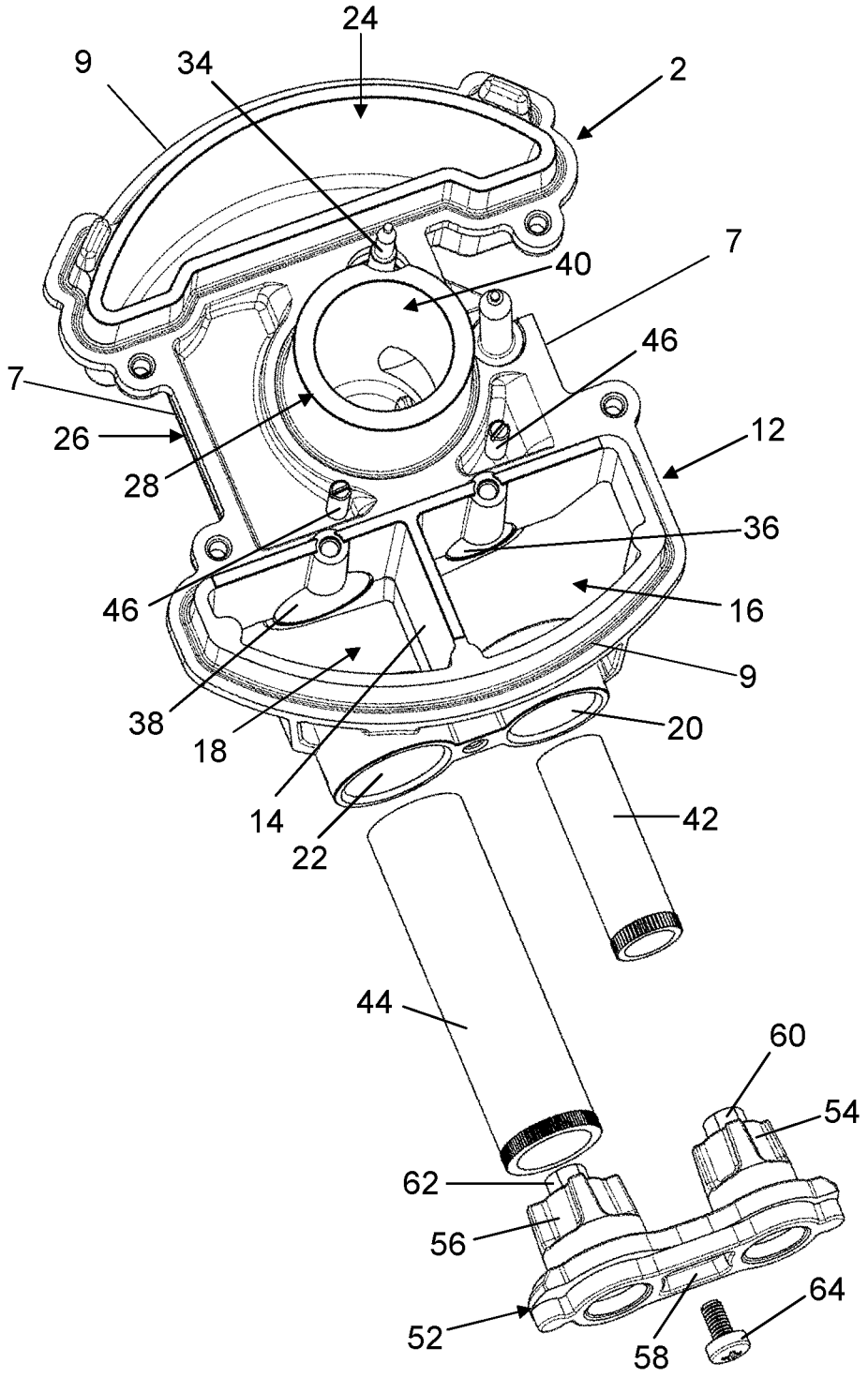
Figure 3:
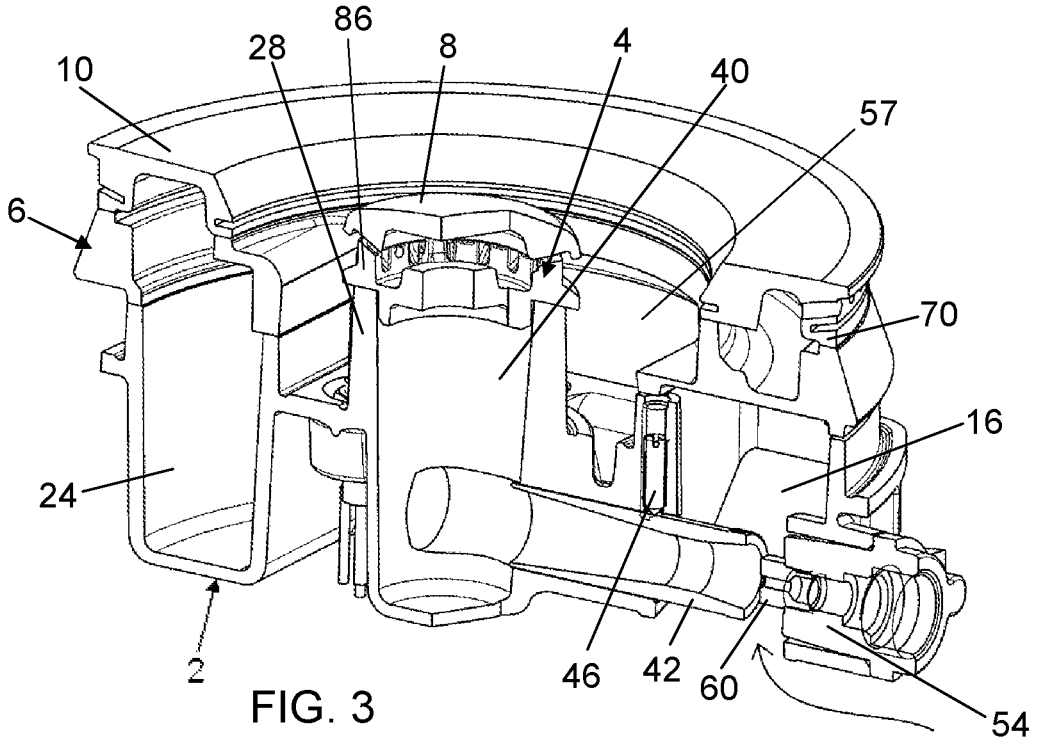
Figure 4:
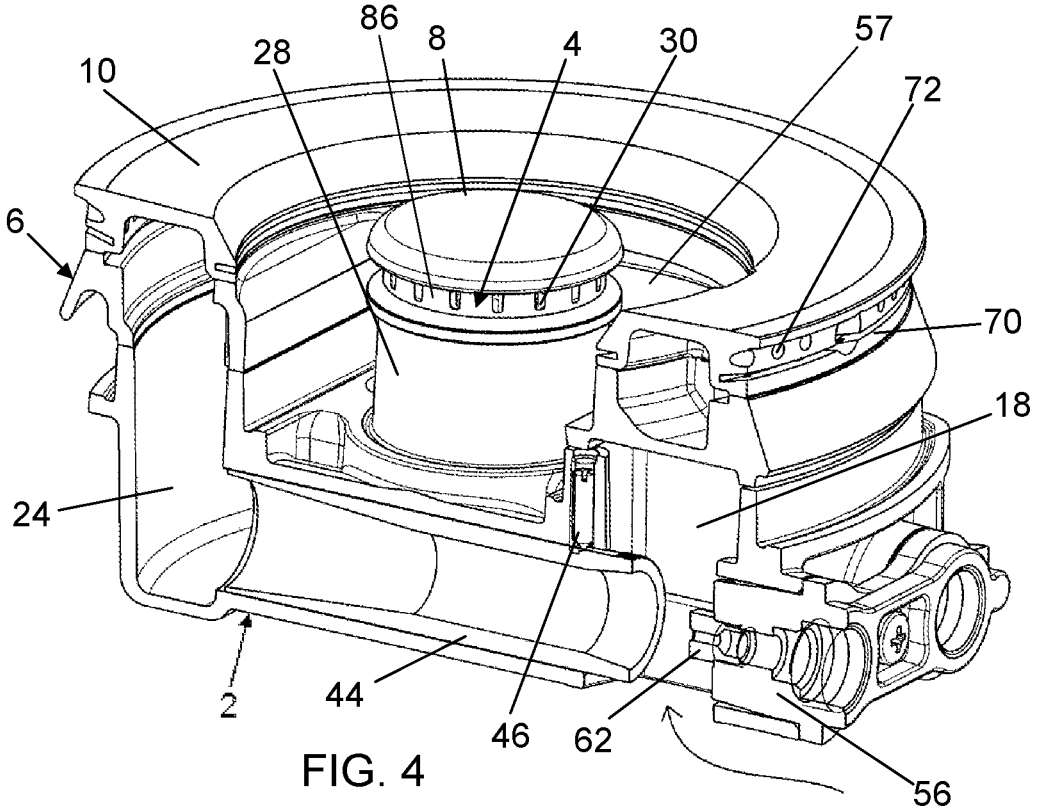
Figure 8:
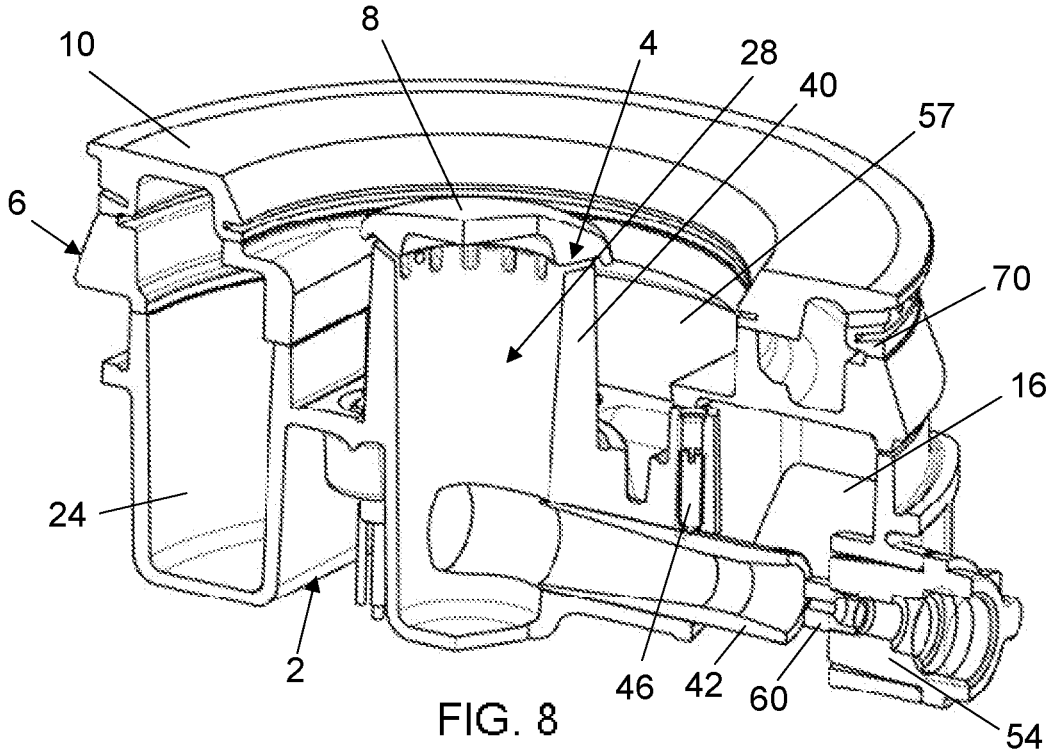
Figure 9:
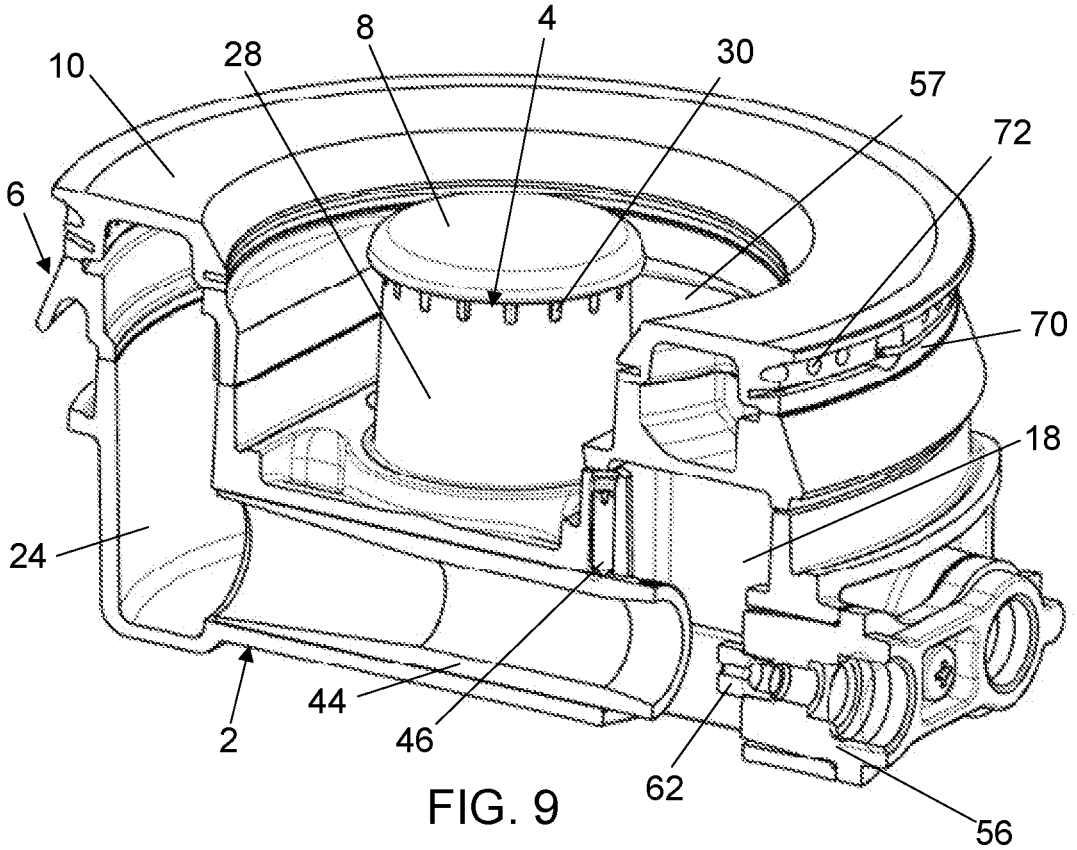

The present invention is hereinbelow further clarified in certain preferred embodiments thereof, which are described by mere way of non-limiting example, with reference to the accompanying drawings, in which:

FIG. 1 shows an exploded perspective view of a burner according to the invention in a first embodiment, applied to a portion of metal sheet of a cooktop, FIG. 2 shows an exploded perspective view of the burner body with its components, FIG. 3 shows it in a partial perspective view, sectioned along the axis of the Venturi duct which feeds the central flame ring, FIG. 4 shows it in a partial perspective view, sectioned along the axis of the Venturi duct which feeds the outer flame ring, FIG. 5 shows it in a sectional vertical view along the axis of the Venturi duct which feeds the central flame ring, in a different embodiment, FIG. 6 shows it in a vertical sectional view along the axis of the Venturi duct which feeds the outer flame ring, in this different embodiment, and FIG. 7 shows an exploded perspective view of a part of the burner body, in one variant, FIG. 8 shows a partial perspective view, sectioned along the axis of the Venturi duct which feeds the central flame ring, of an embodiment of the burner according to the invention with a different burner body, FIG. 9 shows it in a partial perspective view, sectioned along the axis of the Venturi duct which feeds the outer flame ring.

As shown in the figures, the burner according to the invention comprises:

a lower burner body 2 which is intended to be applied below the metal sheet 48 of a cooktop, and to be fixed thereto by means of screws 50, for example, a first burner base 4 for a central flame ring which is integral with the lower burner body 2, a second burner base 6 for one or two annular flame rings, which is conveniently made in a distinct, separate body from the first burner base 4, a circular cap 8 for the first burner base 4, an annular cap 10 for the second burner base 6.

Advantageously, the lower body 2 is made in a single piece. Conveniently, it has an irregular shape but preferably with an outer edge inscribed within a circumference. Preferably, the lower body 2 has, in plan, a shape which may be conceived as resulting from a more or less circular shape but lacking, at the edges 7, two diametrically opposite circular segments which underline two opposite portions with arched edge 9.

In particular, the lower body 2 has a first portion having a first cavity 12, which is divided into two chambers 16, 18 by a vertical wall 14, the chambers being open at the bottom and at the top and having, on the outer wall, two circular through holes 20, 22; a second portion having a second cavity 24, which is located in a substantially diametral position with respect to the first cavity 12, and a third connecting portion between the previous two, indicated as a whole by 26. It has at the top, in a substantially central position, a tubular portion 28 projecting upward and forming, as will be better seen below, the distribution chamber of a gas and primary air mixture, which feeds the central burner base 4. Preferably, the central tubular portion 28 is cylindrical or slightly frustoconical in shape, internally diverging upwards.

The connecting portion 26 is rather narrow and therefore, although the burner body is inscribed within a circumference, it has different horizontal dimensions which are mutually orthogonal. More specifically, one horizontal dimension is equal to the diameter of this ideal circumference, while the horizontal dimension orthogonal thereto is significantly less, and this allows the dimensions in plan of the burner to be reduced with respect to most traditional burners with a circular plan of equal diameter.

In the embodiments depicted in FIGS. 1 to 6, resting on the upper edge of the projecting portion 28 is an upper ring 86, which defines the first burner base or central burner base 4 and which has a plurality of radial openings 30, through which the fuel mixture passes to feed a central flame ring. In particular, the projecting portion 28 obtained in the lower body 2 and the upper ring 86 define the central distribution chamber of the burner.

Conveniently, the burner base 4 is constrained with shape coupling and thus is integral with the projecting portion 28 obtained in the upper surface of the lower body of burner 2. Advantageously, the central burner base 4 consisting of the upper ring 86 is obtained in a distinct, separate body from the second burner base 6, that is the outer annular burner base. This embodiment allows the upper ring 86 of the inner burner base 4 in contact with the flames to be made of a different material from that of the projecting portion 28, and this is advantageous both because it makes the burner suitable to be used in countries where the legislation on the matter prescribes precise features of materials in contact with flames, and because it allows the inner central burner base 4 to be differentiated from the outer annular burner base 6, even in terms of appearance.

In one variant, shown in FIGS. 8 and 9, the openings for allowing the fuel mixture feeding the central flame ring to pass, consist of cavities obtained directly on the upper edge of the projecting portion 28 and closed at the top by cap 8. Thereby, the projecting portion 28 itself along with the circular cap 8 form the central burner base 4, thus eliminating a component of the burner, and also allows increased accuracy for the spark-gap.

Regardless of the embodiment used, a traditional spark plug 32 and a traditional thermocouple 34 are conveniently fixed to the lower body 2, in which the projecting portion 28 forming the central burner base 4 is obtained, which thus take an accurate, stable position with respect to said central burner base 4.

In the connecting portion 26 between the first and second hollow portions of the lower body 2, two parallel cylindrical ducts 36 and 38 are obtained, which are coaxially aligned to the holes 20, 22.

Duct 36 connects the chamber 16 of the first cavity 12 to an inner cavity 40 below the projecting portion 28, while duct 38 connects the chamber 18 of the first cavity 12 to the second cavity 24, obtained in the second portion of the lower burner body 2.

A respective tubular element 42, 44 can be inserted into each of the two cylindrical ducts 36, 38, which tubular element is externally cylindrical and internally Venturi-shaped (Venturi duct-shaped), with a converging segment upstream, followed by a cylindrical central segment and by a successive diverging segment. Obviously, there is a need for the inner diameter of each hole 20, 22 to be greater than the outer diameter of the respective Venturi duct 42, 44 to allow such an insertion.

Each Venturi duct 42, 44 can be locked inside the respective cylindrical duct 36, 38 in the desired axial position by means of a grub screw 46 provided at the inner sidewall of each of the two chambers 16, 18, and can be actuated from above the cooktop where the burner is installed. The length of each Venturi duct is greater than the length of the respective cylindrical duct 36, 38 in which it is accommodated, so as to project from both ends thereof.

The introduction of each Venturi duct 42, 44 into the respective cylindrical duct 36, 38 of the lower body 2 of the burner may be possible through the through holes 20, 22.

The outer edge of both the cavities 12, 24 is surrounded by a flanged portion which is coplanar to a flanged portion on the connecting portion 26 between the two hollow portions, so that these flanged portions as a whole form a continuous flat step, by means of which the lower body 2 adheres to the lower surface of the edge of an opening obtained in the metal sheet 48 of a cooktop, to which the lower body 2 can be constrained by means of screws 50, projecting therefrom with the raised edge of the cavities 16, 18 and 24 and with the upper part of the projecting portion 28, as shown in FIG. 1.

An injector-holder unit 52 can be inserted into the two circular holes 20, 22 obtained in the outer wall of the first cavity 12 of the lower body 2. It consists of two roughly cylindrical bodies 54, 56 joined by a connecting crosspiece 58. It is moreover possible for the injector-holder unit 52 to be made in two separate cylindrical bodies 54, 56 which can be inserted into the two holes 20, 22 of the lower body 2 and constrained thereto with traditional systems.

However, regardless of the embodiment used, a threaded outer cylindrical cavity is obtained in each of these bodies 54, 56 for the attachment of a gas supply conduit, and a threaded inner cylindrical cavity is obtained for restraining an injector 60, 62, which is coaxial with the Venturi duct 42, 44 accommodated in the respective cylindrical duct 36, 38 when the injector-holder unit 52 is constrained to the lower body 2.

The restraint of the injector-holder unit 52 to the lower body 2 is of the removable type and is obtained by means of a screw 64, which crosses the connecting crosspiece 58 and engages the outer wall of the first cavity 12 once the two cylindrical bodies 54, 56 of the injector-holder unit 52 have been inserted into the respective holes 20, 22. To avoid mounting errors, both the two cylindrical bodies 54, 56 and the respective holes 20, 22 have different diameters.

If the injector-holder unit is made instead in two separate cylindrical bodies 54, 56, one for each injector, the restraint of both to the lower body 2 may be obtained with a traditional clip (peg) 66, as shown in FIG. 7, for example.

The second burner base, or annular burner base 6, has an essentially U-shaped radial section with two coaxial cylindrical sidewalls and with an annular bottom connecting them. The annular bottom has an opening 68, which faces the upper opening of the second cavity 24 when the second burner base 6 is correctly placed on the burner body 2.

Cap 8 is arranged on the upper edge of the annular burner base 6. In greater detail, the upper edge of the two concentric walls delimiting the annular cavity of the burner base 6 is smooth, while the annular cap 10 is provided with an annular ridge 70 projecting downward, in which a plurality of radial openings 72 are obtained, through which the mixture of gas and primary air feeding the outer flame ring may pass.

According to needs, the annular burner base 6 may be provided with an outer annular ridge 70, in which the openings are obtained to generate a single outer flame ring, or with an inner annular ridge in which the openings are obtained to generate a single inner flame ring, or with two annular ridges, an inner and an outer ridge, to generate two flame rings, an inner and an outer flame ring.

In the case of the central burner base 4, as in the case of the annular burner base 6, the openings 72 for the fuel mixture to pass could also consist of radial cavities directly obtained on the upper edge of one or both the annular walls of the burner base 6 and closed at the top by cap 10.

Regardless of the embodiment, the annular distribution chamber—defined by the annular burner base 6—for the outer flame ring is separated from the central distribution chamber—defined by the central burner base 4—for the central flame ring by means of an annular space 57. The mounting of the burner according to the invention first involves inserting the two Venturi ducts 42, 44 into the corresponding cylindrical ducts 36, 38 of the burner body 2 and then applying the injector-holder unit 52 to the burner body and fixing it thereto by means of screw 64.

The burner thus mounted is ready to be installed in the cooktop. To this end, the gas feed ducts are fixed to the injector-holder unit 52 and the lower body 2 is fixed to the metal sheet 48 of the cooktop by means of the screws 50.

Finally, the two burner bases 4 and 6 and the two caps 8, 10 are placed on the lower body 2. In particular, the annular burner base 6 is placed on the lower body 2 so as to close the two chambers 16, 18 at the top, which are thus open only at the bottom.

During operation, the gas released from the injectors 60, 62 sucks—through the bottom of the respective chambers 16, 18—the primary air which is mixed with the gas in the Venturi ducts 42, 44 and forms the fuel mixture before being introduced into the cavity 40 of the central projecting portion 28, through which it reaches the central burner base 4, and into cavity 12, from which it then enters in the annular cavity of the burner base 6.

According to the features of the gas available, there is a need to vary the distance between the inlet opening of the Venturi duct 42, 44 and the respective injector 60, 62, and this operation may be easily performed by simply loosening the locking grub screw 46 of either or both Venturi ducts 42, 44 in order to allow the axial adjustment of the Venturi duct 42, 44 itself before it is locked in the correct position again.

In a different embodiment, the injector-holder unit 58 is also made in a single piece with the burner body 2. Obviously, in this case the Venturi ducts 42, 44 cannot be inserted through the application openings of the injector-holder unit 58, but there is a need to obtain similar holes in the outer wall of the second chamber 24, which are closed with specific threaded caps once the Venturi ducts 42, 44 have been inserted.

If the axial adjustability of the Venturi ducts 42, 44 is not required, they may be directly manufactured inside the lower body 2 with traditional techniques, which moreover are rather complex and require sophisticated equipment to be implemented.

Advantageously, in all the embodiments depicted and/or described, the Venturi ducts 42, 44 are substantially horizontal and parallel and are located in said body 2 within the space in plan externally delimited by the annular burner base 6.

However, regardless of the embodiment used, in any case all the surfaces of the lower body 2, central burner base 4 and/or annular burner base 6, which are in contact with one another when the burner is assembled, are subjected to counterboring, which ensures a substantial sealing of the coupling.

In the embodiment shown in FIGS. 5 and 6, there are provided all the features described above, with the exception that the primary air required to form the fuel mixture is sucked from above the cooktop, and to this end the two chambers 16, 18 are manufactured with the bottom closed and are provided with passages at the upper edge in their walls for the primary air to be introduced therein.

Advantageously, this embodiment allows to obtain high insensibility to the streaming effect, not only for the inner flame ring, but also for the outer ring. Conveniently, it is also understood that for the embodiment of the lower body 2 shown in FIGS. 8 and 9, the primary air required to form the fuel mixture may also be sucked from above the cooktop in a corresponding manner to that shown in FIGS. 5 and 6.

From above, it may be easily appreciated that the improved burner according to the invention is particularly advantageous compared to all the traditional burners with several main flame rings, and in particular:

it has the lower body 2 made in a single piece and therefore with more affordable costs both during the production step and the assembly step, and with increased sealing guarantees due to the elimination of couplings which may always be the cause of possible gas leaks, it is easier to be manufactured due to the small number and short extension of the surfaces of the lower body 2 and of the central 4 and/or annular burner base 6 which are to be counterbored, it has high operating reliability due to the accurate positioning of spark 32 with respect to the central burner base 4 and to the subsequent reduction of the tolerances of the spark-gap, it provides increased ease of substitution of the injectors 60, 62, without needing to disassemble the burner, given their direct accessibility from the top, it allows the burner to be used as a multi-ring or dual-ring burner by simply connecting the two gas connections to a single outlet or to two separate outlets of a regulating valve, it allows to vary the distance between each Venturi duct 44, 46 and the corresponding injector 60, 62 easily, and therefore to adapt the burner to different features of the gas fed, it allows the burner base 4 and/or burner base 6 and/or cap 8 and/or cap 10 to be easily replaced with others having different features, both in order to modify the appearance of the burner and to adapt the burner to the legislation on the materials used in the various countries.

The invention claimed is:

1. A multi flame-ring gas burner for cooktops, comprising:

a lower burner body (2), which is mountable on a metal sheet (48) of a cooktop and is configured for application of at least two injectors (60, 62) each facing one of two substantially horizontal, linear Venturi ducts (42, 44) that are provided in said lower burner body (2); and a first burner base (4) with a first circular cap (8) and provided with openings (30) for release of a central flame ring, and a second burner base (6) with a second annular cap (10) and with openings (72), which are provided in one or both of said second burner base (6) or said second annular cap (10), for release of at least one outer annular flame ring, said first and second burner bases (4, 6) being separate and each being in fluid communication with the one of the two Venturi ducts (40, 42), wherein said lower burner body (2) is made in a single piece and is provided with:

a seat for mounting a spark plug (32) interacting with said first burner base (4), the two linear Venturi ducts (42, 44) having substantially parallel axes, and in a substantially central position and at an upper surface thereof, a portion (28) having a tubular extension and projecting upward, and wherein:

said first burner base (4) is integral with said projecting tubular portion (28) of said lower burner body (2), at least one injector-holder unit (52) that is made separately from said lower burner body (2) and is removably constrained to said lower burner body (2) is provided with two portions (54, 56), which are removably insertable into corresponding through holes (20, 22) obtained in said lower burner body (2) in a position facing said Venturi ducts (42, 44), a first one of said two Venturi ducts (42) communicates upstream with a first chamber (16), which carries a first injector (60) applied to a first wall, communicates with an exterior for sucking primary air, and communicates downstream with a second chamber (40) in fluid communication with one of said first burner base (4), a second one of said two Venturi ducts (44) communicates upstream with a third chamber (18), which carries a second injector (62) applied to a second wall, communicates with the exterior for sucking the primary air, and communicates downstream with a fourth chamber (24) in fluid communication with one of said second burner base (6), and at least one of said Venturi ducts (42, 44) is made separately from the lower burner body (2) and consists of an externally cylindrical tubular element configured to be accommodated in a corresponding cylindrical seat (36, 38) obtained in the lower burner body (2) coaxially to the circular through hole (20, 22) which accommodates a part of the injector-holder unit, to which a respective injector (60, 62) is applied, said Venturi duct (42, 44) being insertable into the cylindrical seat (36, 38) of said lower burner body (2) through said circular through hole (20, 22) and being lockable in a desired axial position with a locking element (46) adapted to be actuated from above the lower burner body (2) when applied to the cooktop.

2. The multi flame-ring gas burner according to claim 1, wherein said lower burner body (2) is provided with two cylindrical seats (36, 38) having substantially horizontal and parallel axes, configured to accommodate said Venturi ducts (42, 44) shaped as two tubular elements internally shaped as linear Venturi ducts.

3. The multi flame-ring gas burner according to claim 1, wherein said Venturi ducts (42, 44) are substantially linear and parallel and are obtained in said lower burner body (2) within a space in a plane delimited by the second annular burner base (6).

4. The multi flame-ring gas burner according claim 1, wherein said second burner base (6) is made as a distinct, separate body from said first burner base (4).

5. The multi flame-ring gas burner according to claim 1, further comprising at least one spark plug (32) and a thermocouple (34), which are applied to said lower burner body (2) and are disposed to interact with said first burner base (4).

6. The multi flame-ring gas burner according to claim 1, wherein said first burner base (4) is made as a single piece with said lower burner body (2).

7. The multi flame-ring gas burner according to claim 1, wherein the openings (30, 72) of at least one of said first or said second burner bases (4, 6) are openings obtained in an upper edge thereof, and are delimited at a top by the corresponding cap (8, 10) placed on said burner base.

8. The multi flame-ring gas burner according to claim 1, wherein the openings (30) of said first burner base (4) are obtained at an upper edge of a projecting tubular portion (28) of said lower burner body (2).

9. The multi flame-ring gas burner according to claim 1, wherein the openings (30, 72) of at least one of said first or said second burner bases (4, 6) are obtained in a distinct ring (86) from a remainder of the lower burner body (2) which is interposed between the lower burner body and the respective cap (8, 10).

10. The multi flame-ring gas burner according to claim 9, wherein said distinct ring (86), in which said openings (30, 72) for releasing flames are obtained, is made of a different material from a material of said lower burner body (2).

11. The multi flame-ring gas burner according to claim 1, wherein said first burner base (4) comprises an upper ring (86) which is provided with openings (30) for the release of said central flame ring, and wherein said upper ring (86) is constrained and integral, by shape coupling, with the portion (28) having a tubular extension obtained in said lower burner body (2).

12. The multi flame-ring gas burner according to claim 1, wherein said locking element (46) comprises a grub screw engaged in a threaded seat obtained in said lower burner body (2) and engaging, with its tip, an outer surface of said tubular element.

13. The multi flame-ring gas burner according to claim 1, wherein said cylindrical seat (36, 38) obtained in the lower burner body (2) for each Venturi duct (42, 44) communicates with two chambers (16, 18, 24, 40), also obtained in the lower burner body (2), one of said chambers (16, 18) accommodating said injector (60, 62) and communicating with the exterior, the other one of said chambers (24, 40) being in fluid communication with the respective burner base (4, 6).

14. The multi flame-ring gas burner according to claim 1, wherein said injector-holder unit (52) is made separately from said burner body (2) and in a single piece for all the injectors (60, 62).

15. The multi flame-ring gas burner according to claim 1, wherein said injector-holder unit (52) comprises a connecting crosspiece (58) for said two portions (54, 56), and wherein said injector-holder unit (52) is constrained to the lower burner body (2) with a screw (64) which crosses the connecting crosspiece (58) and engages said lower burner body (2).

16. The multi flame-ring gas burner according to claim 1, wherein said injector-holder unit is made separately from said lower burner body (2), in several parts which are constrained thereto and each adapted for application of an injector (60, 62).

17. The multi flame-ring gas burner according to claim 1, wherein each of said two portions (54, 56) of said injector-holder unit (52) comprises a gas connection and means for constraining a corresponding injector (60, 62), said means being configured so that when said injector-holder unit (52) is constrained to said lower burner body (2), each injector (60, 62) is coaxial to a corresponding Venturi duct (42, 44).

18. The multi flame-ring gas burner according to claim 13, wherein said chambers (16, 18) obtained in said lower burner body (2) are open at a bottom and are closed at a top by said second annular burner base (6) positioned on said lower burner body (2), or are closed at the bottom and are provided, on an edge thereof, with passages communicating with the exterior above the metal sheet of the cooktop to which said burner is adapted to be installed.

* * * * *